United States Patent [19]

Petterson

[11] Patent Number: 5,015,111

[45] Date of Patent: May 14, 1991

[54] ERASER DISPENSER AND WRITING INSTRUMENT EQUIPPED WITH ERASER DISPENSER

[75] Inventor: Tor Petterson, Rancho Palos Verdes, Calif.

[73] Assignee: Pentel of America, Ltd., Torrance, Calif.

[21] Appl. No.: 485,229

[22] Filed: Feb. 26, 1990

Related U.S. Application Data

[63] Continuation of Ser. No. 167,549, Mar. 14, 1988, Pat. No. 4,904,101.

[51] Int. Cl.[5] ..... B43K 29/02

[52] U.S. Cl. ..... 401/52; 15/429; 15/433; 401/19; 401/31; 401/78

[58] Field of Search ..... 132/318; 401/29, 52, 401/78, 116, 31, 30, 32, 16–19, 65, 195; 15/424, 427–434, 425, 426

[56] References Cited

U.S. PATENT DOCUMENTS

| | | | |
|---|---|---|---|
| Re. 22,717 | 2/1946 | Savoie | 401/52 |
| 364,916 | 6/1887 | Goldsmith | 401/52 |
| 1,461,437 | 7/1923 | Billman | 15/429 |
| 1,571,794 | 2/1926 | Pinkham | 401/78 |
| 2,173,361 | 9/1939 | Gorrell | 15/429 |
| 2,198,335 | 4/1940 | Gaimari | 15/429 |
| 2,204,038 | 6/1940 | Findra | 15/429 |
| 2,286,878 | 6/1942 | Tefft | 15/429 |
| 2,293,993 | 8/1942 | Lynn | 15/429 |
| 2,469,631 | 5/1949 | Broder | 401/78 |
| 2,525,229 | 10/1950 | Lynn | 401/65 |
| 2,532,037 | 11/1950 | Robbins | 15/429 |
| 2,710,614 | 6/1955 | Dulberg | 132/79 |
| 2,720,966 | 10/1955 | Davis | 401/78 |
| 3,124,106 | 3/1964 | Kosta | 401/116 X |
| 3,442,596 | 5/1969 | Tsukahara | 401/84 |
| 3,586,452 | 6/1971 | Mason | 401/78 |
| 4,140,408 | 2/1979 | Mizutani | 401/65 |

FOREIGN PATENT DOCUMENTS

| | | | |
|---|---|---|---|
| 695425 | 8/1940 | Fed. Rep. of Germany | 401/77 |
| 57-132598 | 8/1982 | Japan . | |
| 58-074584 | 5/1983 | Japan . | |

*Primary Examiner*—Richard J. Johnson

*Attorney, Agent, or Firm*—Bruce L. Adams; Van C. Wilks

[57] ABSTRACT

A pencil has front and rear barrels mounted on an inner barrel. The rear and inner barrels are axially displaceable as a unit relative to the front barrel to advance a lead, and the rear barrel is angularly displaceable in opposite directions relative to the front and inner barrels to axially extend and retract an eraser. The eraser is carried by an eraser holder having projections which ride in helical grooves formed in the rear barrel, and the eraser holder is prevented from undergoing rotation. Angular displacement of the rear barrel effects axial displacement of the eraser holder so as to extend and retract the eraser depending on the direction of angular displacement of the rear barrel.

20 Claims, 2 Drawing Sheets

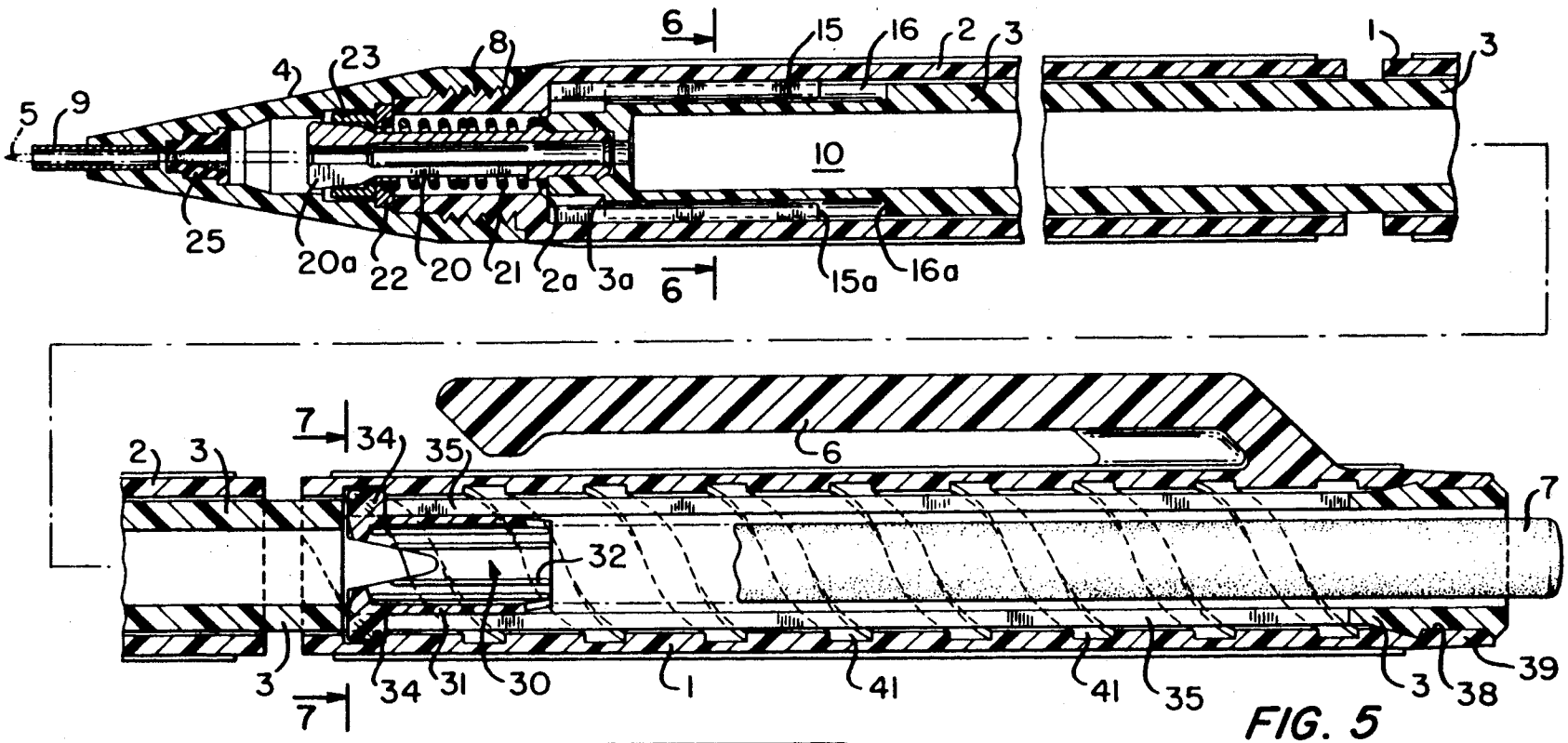
FIG. 5
FIG. 9
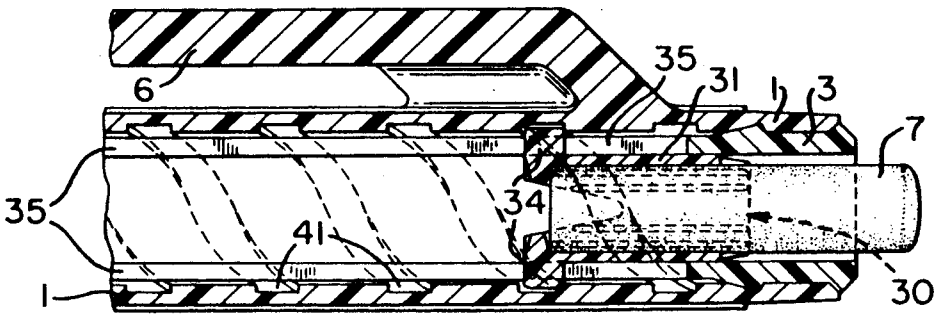

ERASER DISPENSER AND WRITING INSTRUMENT EQUIPPED WITH ERASER DISPENSER

This is a continuation of application Ser. No. 167,549, filed Mar. 14, 1988 U.S. Pat. No. 4,904,101.

BACKGROUND OF THE INVENTION (1) Field of the Invention

The present invention relates generally to an eraser dispenser for selectively extending and retracting an eraser and to a writing instrument equipped with such an eraser dispenser.

(2) Background Information

Writing instruments, such as pencils and pens using erasable ink, are known which are provided with erasers for erasing mistakes, stray marks or other written matter. These writing instruments typically include erasers that are of a short overall length and, therefore, tend to be consumed relatively quickly. Thus there is a frequent need to replace a worn eraser with a new one.

These prior art erasers are generally of two types. One type consists of a relatively short eraser inserted in an eraser cup which is removably inserted in the rear end of the writing instrument. When the eraser becomes worn and needs replacement, the eraser cup is removed from the instrument, the worn eraser is removed from the eraser cup and replaced by a new one, and then the eraser cup is removably inserted back on the writing instrument. One disadvantage of this type eraser unit is that the length of the eraser must be kept relatively short, otherwise the stresses applied by the erasing procedure will break the eraser. Due to the short length of the eraser, it must be frequently replaced. Another disadvantage is that the eraser is continuously exposed at the rear of the writing instrument and is, therefore, susceptible to being easily broken or damaged.

The other type comprises an eraser of relatively long length which is removably held by a slotted metal sleeve. The sleeve is removably inserted into an opening at the rear end of the writing instrument, and the to-be-used portion of the eraser is housed within the rear end of the instrument. When the eraser becomes sufficiently worn, the slotted metal sleeve is removed from the instrument and manually opened so as to permit the eraser to be extended relative to the sleeve. The sleeve is then manually closed and reinserted into the rear end of the instrument. This procedure must be repeated each time the eraser become worn and a new eraser section is needed. Such an eraser unit is disadvantageous because of the manipulations and time required to extend the eraser. In addition, such prior art eraser units suffer the drawback that the eraser is continuously exposed and thus easily susceptible to breakage or damage. If a protective cap is placed over the eraser, the cap must be removed each time the eraser is used which is both troublesome and inconvenient.

SUMMARY OF THE INVENTION

It is a primary object of the present invention to provide an eraser dispenser and a writing instrument equipped with an eraser dispenser which overcome the aforementioned drawbacks and disadvantages of prior art constructions.

It is another object of the present invention to provide an eraser dispenser in which the eraser can be easily extended and retracted by simply rotating a portion of the eraser dispenser.

A further object of the present invention is to provide an eraser dispenser which accommodates an eraser of relatively long length thereby reducing the frequency of replacement of the eraser.

A still further object of the present invention is to provide a writing instrument having an eraser dispenser at the rear end thereof in which the eraser can be easily extended from or retracted into the rear end of the instrument in response to rotation of a portion of the instrument.

The above and other objects of the invention are achieved by an eraser dispenser comprised of an inner tubular member, an eraser slideably disposed in the inner tubular member, and an outer tubular member rotatably encircling the inner tubular member. The rotation of the outer tubular member is converted into axial displacement of the eraser within the inner tubular member. In this manner, when the outer tubular member is rotated in one direction, the eraser is extended from the end of the inner tubular member and when the outer tubular member is rotated in the other direction, the eraser is retracted into the inner tubular member. The eraser dispenser is incorporated into the rear portion of a writing instrument, such as a pen using erasable ink or a pencil.

Other objects, features and advantages of the present invention will become apparent to persons of ordinary skill in the art upon a reading of the following description of the invention with reference to the accompanying drawings.

BRIEF DESCRIPTION OF THE DRAWINGS

FIG. 5 is an enlarged longitudinal cross-sectional view of the pencil shown in FIG. 1 and showing the dispensing mechanism in its fully retracted state;

FIG. 9 is an enlarged longitudinal cross-sectional view of the rear end of the pencil similar to that shown in FIG. 5 tut showing the dispensing mechanism in its fully advanced state.

DETAILED DESCRIPTION OF THE INVENTION

One preferred embodiment of the present invention will be described hereinafter with reference to the drawings. For purposes of description, the invention will be described with reference to a push-button type lead pencil. It is understood, however, that the invention is applicable to any type of writing instrument, e.g., automatic or mechanical pencil, pen, marker and the like. Moreover, as will be more fully apparent from the following description, the eraser dispenser of the present invention can be constructed as a separate device and need not be embodied as part of a writing instrument.

Figure 2:
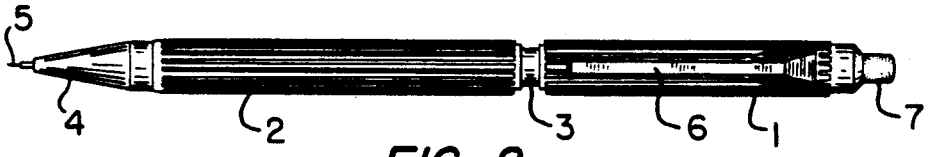
FIG. 2 is a longitudinal side view of the pencil shown in FIG. 1 with the dispensing mechanism rotated 90° to show the advancement of the eraser.

A push-button type lead pencil incorporating the eraser dispenser of the present invention is shown in FIGS. 1–4. The pencil comprises rear and forward tubular members 1 and 2 disposed over an inner tubular member 3. The tubular members 1, 2, 3 are commonly referred to in the art as barrels and constitute the main body of the pencil. A writing tip 4 is threadedly attached to the front barrel or tubular member 2 and guides a writing lead 5 which projects from the forward end of the writing tip 4. A clip 6 is secured to the rear barrel or tubular member 1 for clipping the pencil to a shirt or jacket pocket or the like. An eraser 7 projects from the rear end of the barrel 1 and in accordance with the invention, the eraser 7 can be extended or retracted in response to angular turning movement of the rear barrel 1. For example, as shown in FIG. 2, the eraser 6 is extended when the rear barrel 1 is angularly displaced 90° from the position shown in FIG. 1.

Figures 1, 3, 4:
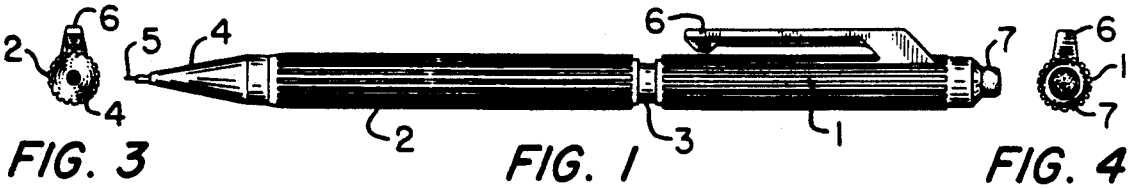
FIG. 1 is a longitudinal side view of a pencil equipped with an eraser dispenser constructed according to the principles of the present invention.
FIG. 3 is a front end view of the pencil shown in FIG. 1.
FIG. 4 is a rear end view of the pencil shown in FIG. 1.

FIG. 5 is an enlarged longitudinal cross-sectional view of the pencil shown in FIG. 1. The forward barrel 2 encircles the forward portion of the inner barrel 3 which extends substantially the entire length of the pencil. The writing tip 4 is threadedly connected to the front barrel 2 by complementary screw threads 8. A sleeve 9 projects from the front end of the writing tip 4 for guiding therethrough the lead 5. The interior of the inner barrel 3 defines a storage compartment 10 for storing writing leads which are individually fed from the storage compartment 10 along a central lead passageway which terminates at the sleeve 9.

Figure 6:
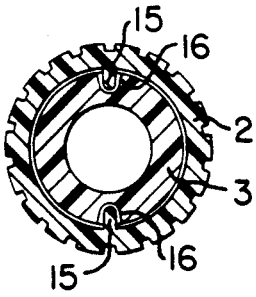
FIG. 6 is a cross-sectional view taken along the lines 6—6 of FIG. 5.

The inner barrel 3 is mounted within the front barrel 2 to undergo limited axial displacement relative to the front barrel 2 but not rotation relative to the front barrel 2. For this purpose, the front barrel 2 is formed with a pair of diametrically opposed projections 15 which project radially inwardly and extend axially along the front barrel 2 as shown in FIGS. 5 and 6. The projections 15 cooperate with axially extending grooves 16 formed in the inner barrel 3 so as to prevent relative rotation between the inner barrel 3 and the front barrel 2 while simultaneously permitting axial movement of the inner barrel 3 relative to the front barrel 2. Stated otherwise, the surfaces of the projections 15 slidably engage with the surfaces defining the grooves 16, and these interengaging surfaces prevent relative rotation between the front and inner barrels 2 and 3 while permitting axial displacement of the inner barrel 3. The extent of axial displacement of the inner barrel 3 is determined by the length of the axial grooves 16 which are slightly longer than the axial projections 15 to thereby limit the extent of axial displacement of the inner barrel 3. As described hereafter, the axial displacement of the inner barrel 3 is used to advance the lead 5 in response to a pushing force exerted on the rear end of the inner barrel 3, and such is a characteristic feature of the push-button type pencils A compartment is formed inside the writing tip 4 and the inner barrel 3 for housing the lead-advancing mechanism. The mechanism comprises a chuck 20 for releasably gripping the lead. The chuck 20 has a tubular body portion which is slotted to provide at its forward end a plurality of radially flexible chuck elements 20*a*. The chuck 20 is secured to the front end of the inner barrel 3 so as to undergo axial displacement therewith. A compression spring 21 surrounds the tubular body portion of the chuck 20, and the spring 21 is compressed between the front end of the inner barrel 3 and a spring collar 22. In this manner, the inner barrel 3 together with the chuck 20 are biased rearwardly and normally assume the positions shown in FIG. 5. A chuck collar 23 abuts the spring collar 22 and functions to urge the chuck elements 20*a* into a closed, lead-gripping state when the chuck 20 is seated as shown in FIG. 5. A lead grommet 25 is located just rearwardly of the sleeve 9 and tapers in the forward direction to guide the lead 5 into the sleeve 9 as the lead is forwardly advanced by the chuck 20.

In order to advance the lead 5, a pushing force is exerted on the rear end of the inner barrel 3 to axially displace the inner barrel 3 and the chuck 20 thereby compressing the spring 21. As the chuck 20 advances forwardly, the chuck 20 carries the lead 5 due to the gripping action of the chuck elements 20*a*. The axial displacement of the inner barrel 3 is guided by the front barrel projections 15 and the inner barrel grooves 16, and the extent of forward displacement of the inner barrel 3 is controlled by abutment of a front shoulder 3*a* of the inner barrel 3 with a shoulder 2*a* of the front barrel 2 and/or by abutment of the rear ends 15*a* of the projections 15 with the wall portion 16*a* of the inner barrel 3 which defines the rear ends of the grooves 16. As the lead 5 is advanced forwardly by the chuck 20, the lead frictionally slides through the lead grommet 25. After the pushing force exerted on the rear end of the inner barrel 3 is removed, the compressed spring 21 urges the inner barrel 3 rearwardly to its initial position. As the barrel 3 and the chuck 20 move rearwardly, the frictional force exerted by the grommet 25 on the lead 5 is sufficient to retain the lead in its advanced position. In other words, the frictional force exerted on the lead 5 by the lead grommet 25 is stronger than the gripping force exerted by the chuck elements 20*a* once the chuck elements 20*a* are released from the confines of the chuck collar 23.

The eraser dispenser is incorporated in the rear end of the pencil as shown in FIG. 5. The eraser dispenser comprises a tubular housing for holding the eraser 7 which, in this embodiment, comprises the inner barrel 3, and dispensing means in the form of an outer tubular member which, in this embodiment, comprises the rear barrel 1. The eraser 7 is arranged to undergo axial displacement within the inner barrel 3 in response to angular displacement or turning of the outer rear barrel 1 to thereby extend or retract the eraser 7 depending on the direction of turning of the rear barrel 1.

Figure 7:
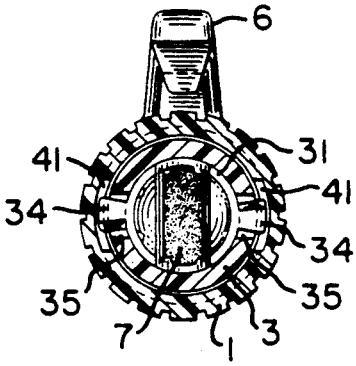
FIG. 7 is a cross-sectional view of the pencil taken along the lines 7—7 of FIG. 5.

The eraser 7 consists of a well known erasing medium which is effective to erase a particular writing medium. If the writing medium is a pencil lead, then the erasing medium may be any conventional pencil eraser material. If the writing medium is an ink, then the erasing medium would be any suitable ink eraser material. The eraser 7 has a cylindrical shape and is replaceably inserted into and held by holding means 30. In this embodiment, the holding means 30 comprises an eraser cup in the form of a sleeve 31 provided with internal ribs 32. The ribs 32 provide a firm gripping action for holding the eraser 7 and for preventing relative movement between the sleeve 31 and the eraser 7. A pair of projections 34 are connected at one end of the sleeve 31 and extend radially outwardly thereof as shown in FIGS. 5 and 7. The inner barrel 3 is provided with a pair of axially extending slots 35 which slidably receive therein respective ones of the projections 34. The sleeve 31 is slidably mounted within the interior of the inner barrel 3 and, by virtue of the projection-and-slot connection 34, 35, the sleeve 31 can undergo axial displacement along the length of the inner barrel 3 but cannot undergo angular displacement or turning relative to the inner barrel 3.

Figure 8:
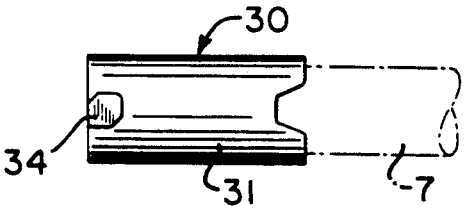
FIG. 8 is a side view of an eraser cup which forms part of the eraser dispenser.

The rear barrel 1 is rotatably disposed on the inner barrel 3 so as to undergo angular displacement or turning movement relative to the inner barrel 3. For this purpose, the inner barrel 3 is formed at its rear end with an annular groove 38 in which is rotatably disposed an annular projection 39 of the rear barrel 1. The barrels 1 and 3 are formed, in this embodiment, of suitable plastic material which possesses a sufficiently low coefficient of friction to permit easy rotation of the rear barrel 1 relative to the inner barrel 3. The mounting structure comprised of the interengaging surfaces of the annular groove 38 and the annular projection 39 also locks the barrels 1 and 3 axially so that the rear barrel 1 cannot move axially relative to the inner barrel 3. By such a construction, the two barrels 1 and 3 undergo axial displacement together as a unit relative to the front barrel 2. If desired, suitable bearing material can be inserted between the engaging surfaces of the rear barrel 1 and the inner barrel 3 to assist in the rotational mounting of the rear barrel 1 on the inner barrel 3. A pair of continuous helical grooves 41 are formed on the inner surface of the rear barrel 1 and slidably receive therein respective ones of the sleeve projections 34 as shown in FIGS. 5 and 7. The helical grooves 41 define helical tracks for the projections 34 so that when the rear barrel 1 is angularly displaced, the angular motion of the barrel 1 is converted into linear motion of the sleeve 31 due to the sliding engagement of the sleeve projections 34 in the helical grooves 41. As shown in FIG. 8, the projections 34 have an angled profile which complements the helix angle of the helical grooves thereby efficiently converting the angular, turning movement of the rear barrel 1 into linear, axial movement of the sleeve 31.

During use of the eraser dispenser, an eraser 7 is replaceably inserted into the holding means 30 which is then displaced to its forwardmost position as shown in FIG. 5. In this position, the distal end of the eraser 7 projects a suitable distance from the rear end of the inner barrel 3. After the projecting part of the eraser 7 is consumed through repeated use, the eraser 7 can be extended by simply turning the rear barrel 1 in the appropriate direction to cause axial displacement of the holding means 30 along the interior of the inner barrel 3. In this manner, the rear barrel 1 functions as dispensing means for dispensing the eraser 7 in accordance with the extent of angular displacement of the rear barrel 1. When the rear barrel 1 is turned in the other direction, the holding means 30 is axially displaced forwardly and retracts the eraser 7 into the inner barrel 3. FIG. 9 shows the holding means 30 in its fully advanced state with the eraser 7 almost fully consumed. When it is desired to replace a worn eraser with a fresh one, the worn eraser is simply pulled axially out of the holding means 30 and a fresh one inserted in its place. The rear barrel 1 is then rotated in the appropriate direction to axially displace the holding means 30 to its fully retracted state as shown in FIG. 5.

While the invention has been described with reference to a specific embodiment thereof, it is not intended to be so limited thereby, and obvious modifications and substitutions of equivalents will be apparent to those having ordinary skill in the art, and all such obvious modifications and substitutions are intended to be covered by the scope of the appended claims. For example, if it is desired to construct the eraser dispenser as a separate device which is not incorporated in a writing instrument, such a device would correspond essentially to the structure shown in the bottom half of FIG. 5. In such a case, the inner barrel 3 would be severed in the region between the rear and front barrels 1 and 2, and a suitable closure member would be provided to close the open severed end of the inner barrel 3.

What is claimed is:

1. A writing instrument comprising: a front tubular member having a writing tip at the front end thereof; advancing means axially displaceable in forward and rearward directions for incrementally advancing a writing medium lengthwise in the forward direction through the writing tip in response to forward axial displacement of the advancing means; an inner tubular member having a front portion disposed within and encircled by the front tubular member and having a rear portion; a rear tubular member disposed over and encircling the rear portion of the inner tubular member; means mounting the rear and inner tubular members for axial displacement together as a unit in forward and rearward directions relative to the front tubular member to effect forward axial displacement of the advancing means to thereby incrementally advance the writing medium; means mounting the rear tubular member for angular displacement in opposite directions relative to the front and inner tubular members; holding means disposed within the inner tubular member for releasably holding an elongate eraser; and means mounting the holding means to undergo axial displacement in forward and rearward directions within the inner tubular member in response to angular displacement of the rear tubular member in opposite directions to thereby axially retract and extend the eraser relative to the rear end of the rear tubular member.

2. A writing instrument according to claim 1; wherein the means mounting the rear and inner tubular members for axial displacement together as a unit includes interengaging surfaces of the rear and inner tubular members.

3. A writing instrument according to claim 2; wherein the interengaging surfaces have a configuration effective to lock together the rear and inner tubular members for axial displacement as a unit while permitting angular displacement of the rear tubular member relative to the inner tubular member.

4. A writing instrument according to claim 1; wherein the means mounting the rear tubular member for angular displacement relative to the front and inner tubular members comprises means for preventing relative rotation between the front and inner tubular members, and means mounting the rear tubular member for angular displacement about the inner tubular member.

5. A writing instrument according to claim 4; wherein the means for preventing relative rotation includes interengaging surfaces of the front and inner tubular members.

6. A writing instrument according to claim 5; wherein the interengaging surfaces have a configuration effective to prevent relative rotation between the front and inner tubular members while permitting axial displacement of the inner tubular member relative to the front tubular member.

7. A writing instrument according to claim 5; wherein the means mounting the holding means includes means defining at least one helical track in one of the rear or inner tubular members, and means coacting with the helical track for converting angular displacement of the rear tubular member to axial displacement of the holding means.

8. A writing instrument according to claim 7; wherein the means coacting with the helical track comprises at least one projection extending outwardly of the holding means and slidably engageable in the helical track, and at least one slot extending axially of the inner tubular member and slidably receiving therethrough the projection to thereby permit axial displacement of the holding means while preventing angular displacement thereof.

9. A writing instrument according to claim 8; wherein the helical track is disposed on the interior surface of the rear tubular member.

10. A writing instrument according to claim 7; wherein the means defining at least one helical track comprises means defining two helical tracks in the interior surface of the rear tubular member; and the holding means comprises an eraser holder releasably holding the elongate eraser, the eraser holder having a pair of oppositely disposed projections extending outwardly therefrom in slidable engagement with respective ones of the helical tracks.

11. A pencil comprising: front and rear tubular members coaxially disposed on a longitudinal axis; a pencil tip connected to the front end of the front tubular member; lead-advancing means axially displaceable in forward and rearward directions for incrementally advancing a pencil lead lengthwise in the forward direction through the pencil tip in response to forward axial displacement of the lead-advancing means; means mounting the rear tubular member for axial displacement in forward and rearward directions relative to the front tubular member to effect forward axial displacement of the lead-advancing means to thereby incrementally advance the pencil lead; means mounting the rear tubular member for angular displacement in opposite directions about the longitudinal axis relative to the front tubular member; holding means disposed within the rear tubular member for releasably holding an elongate eraser; and means mounting the holding means to undergo axial displacement in forward and rearward directions within the rear tubular member in response to angular displacement of the rear tubular member in opposite directions to thereby axially retract and extend the eraser relative to the rear end of the rear tubular member.

12. A pencil according to claim 11; wherein the means mounting the holding means includes means defining at least one helical track on the interior surface of the rear tubular member, and means coacting with the helical track for converting angular displacement of the rear tubular member to axial displacement of the holding means.

13. A pencil according to claim 12; wherein the means coacting with the helical track comprises at least one projection projecting outwardly of the holding means and slidable along the helical track, and means engageable with the projection for permitting axial displacement of the holding means and preventing angular displacement thereof in response to angular displacement of the rear tubular member.

14. A pencil according to claim 13; wherein the means engageable with the projection comprises an inner tubular member extending axially within the rear tubular member and having the holding means slidably mounted therein to undergo axial displacement, the inner tubular member having at least one axially extending slot through which the projection slidably extends, means mounting the rear tubular member for angular displacement relative to the inner tubular member, and means connecting the inner tubular member to the front tubular member to prevent relative angular displacement therebetween.

15. A pencil according to claim 14; wherein the means mounting the rear tubular member for axial displacement relative to the front tubular member comprises means connecting the rear tubular member to the inner tubular member for axial displacement together as a unit.

16. A pencil according to claim 14; wherein the means defining at least one helical track comprises means defining two helical tracks on the interior surface of the rear tubular member, and the means coacting comprises two projections projecting outwardly of the holding means and slidable along respective ones of the helical tracks.

17. A pencil according to claim 16; wherein the holding means comprises an eraser holder releasably holding the elongate eraser, the two projections projecting outwardly from the eraser holder at diametrically opposite locations.

18. A pencil according to claim 11; wherein the means mounting the rear tubular member for axial displacement relative to the front tubular member comprises an inner tubular member having a front portion extending axially within the front tubular member and a rear portion extending axially within the rear tubular member, means connecting the rear and inner tubular members for axial displacement together as a unit, and means mounting the inner tubular member for axial displacement within the front tubular member.

19. A pencil according to claim 18; wherein the means mounting the inner tubular member for axial displacement includes means for preventing angular displacement of the inner tubular member relative to the front tubular member.

20. A pencil according to claim 19; wherein the means for preventing angular displacement of the inner tubular member relative to the front tubular member comprises interengaging surfaces of the front and inner tubular members.

* * * * *

US005015111B1

REEXAMINATION CERTIFICATE (3169th)

United States Patent [19] [11] B1 5,015,111

Petterson [45] Certificate Issued Apr. 8, 1997

[54] ERASER DISPENSER AND WRITING INSTRUMENT EQUIPPED WITH ERASER DISPENSER

[75] Inventor: Tor Petterson, Rancho Palos Verdes, Calif.

[73] Assignee: Pentel of America, Ltd., Torrance, Calif.

Reexamination Request:
No. 90/002,698, Apr. 8, 1992

Reexamination Certificate for:

| | |
|---|---|
| Patent No.: | **5,015,111** |
| Issued: | **May 14, 1991** |
| Appl. No.: | **485,229** |
| Filed: | **Feb. 26, 1990** |

Related U.S. Application Data

[63] Continuation of Ser. No. 167,549, Mar. 14, 1988, Pat. No. 4,904,101.

[51] Int. Cl.[6] ..... B43K 29/02

[52] U.S. Cl. ..... 401/52; 401/19; 401/31; 401/78; 15/429; 15/433

[56] References Cited

U.S. PATENT DOCUMENTS

| | | | |
|---|---|---|---|
| 2,469,631 | 5/1949 | Broder . | |
| 2,525,229 | 10/1950 | Lynn | 15/429 |
| 4,386,865 | 6/1983 | Kageyama et al. | 401/67 |

FOREIGN PATENT DOCUMENTS

| | | |
|---|---|---|
| 57-132593 | 8/1982 | Japan . |
| 61-081987 | 5/1986 | Japan . |

*Primary Examiner*—Danton DeMille

[57] ABSTRACT

A pencil has front and rear barrels mounted on an inner barrel. The rear and inner barrels are axially displaceable as a unit relative to the front barrel to advance a lead, and the rear barrel is angularly displaceable in oppposite directions relative to the front and inner barrels to axially extend and retract an eraser. The eraser is carried by an eraser holder having projections which ride in helical grooves formed in the rear barrel, and the eraser holder is prevented from undergoing rotation. Angular displacement of the rear barrel effects axial displacement of the eraser holder so as to extend and retract the eraser depending on the direction of angular displacement of the rear barrel.

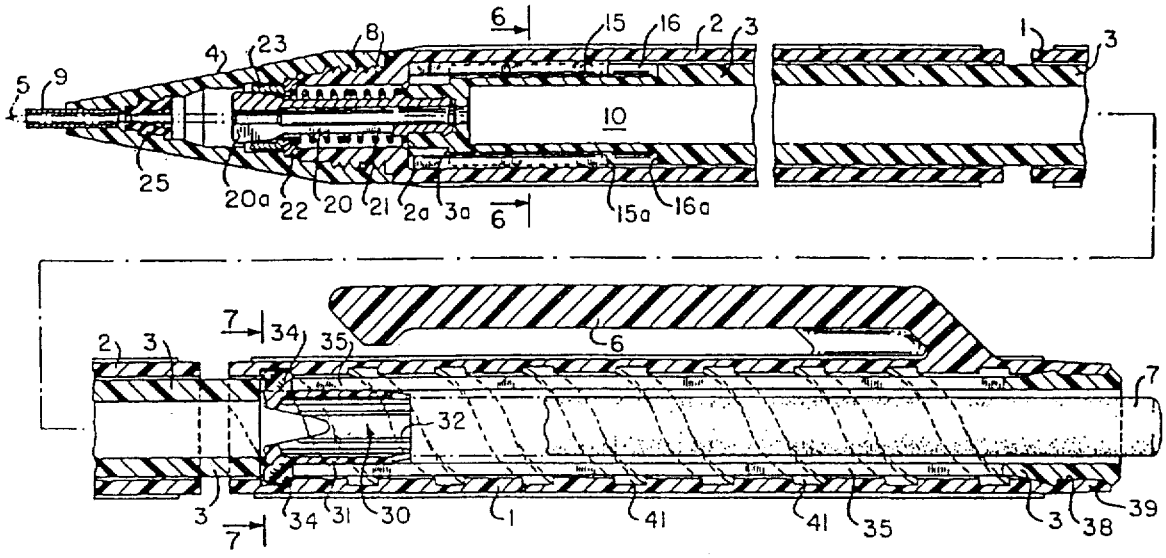

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–10 and 18–20 is confirmed.

Claims 11–17 having been finally determined to be unpatentable, are cancelled.

New claims 21–34 are added and determined to be patentable.

*21. A pencil according to claim 18; wherein the means mounting the inner tubular member for axial displacement within the front tubular member comprises axially extending surfaces on the inner tubular member slidably engaged with corresponding axially extending surfaces on the front tubular member.*

*22. A pencil according to claim 21; wherein the slidably engaged surfaces on the inner and front tubular members are configured to prevent angular displacement of the inner tubular member relative to the front tubular member.*

*23. A pencil according to claim 21; wherein the axially extending surfaces of the inner tubular member are formed on the outside of the inner tubular member, and the axially extending surfaces of the front tubular member are formed on the inside of the front tubular member.*

*24. A pencil according to claim 18; wherein a portion of the inner tubular member extends axially forward of the rear tubular member, said portion of the inner tubular member having throughout the axial length thereof an outer diameter smaller than the inner diameter of the rear tubular member.*

*25. A pencil according to claim 18, wherein the rear tubular member has a freely exposed outer peripheral surface capable of being manually gripped by a user of the pencil to effect angular displacement thereof to axially retract and extend the eraser.*

*26. A pencil according to claim 25; wherein the means mounting the holding means includes means defining at least one helical track on the interior surface of the rear tubular member, and means coacting with the helical track for converting angular displacement of the rear tubular member to axial displacement of the holding means.*

*27. A pencil according to claim 26; wherein the means coacting with the helical track comprises at least one projection projecting outwardly of the holding means and slidable along the helical track, and at least one axially extending slot in the inner tubular member and through which the projection slidably extends.*

*28. A pencil according to claim 27; wherein the projection projects radially outwardly from the longitudinal axis an extent farther than the farthest radial extent of the inner tubular member as viewed along the entire length of the inner tubular member excluding the rear end portion thereof.*

*29. A writing instrument according to claim 1; wherein the means mounting the rear and inner tubular members for axial displacement includes means mounting the inner tubular member for axial displacement within the front tubular member, said means comprising axially extending surfaces on the inner tubular member slidably engaged with corresponding axially extending surfaces on the front tubular member.*

*30. A writing instrument according to claim 29; wherein the slidably engaged surfaces on the inner and front tubular members are configured to prevent angular displacement of the inner tubular member relative to the front tubular member.*

*31. A writing instrument according to claim 29; wherein the axially extending surfaces of the inner tubular member are formed on the outside of the inner tubular member, and the axially extending surfaces of the front tubular member are formed on the inside of the front tubular member.*

*32. A writing instrument according to claim 1; wherein a portion of the inner tubular member extends axially forward of the rear tubular member, said portion of the inner tubular member having throughout the axial length thereof an outer diameter smaller than the inner diameter of the rear tubular member.*

*33. A writing instrument according to claim 1; wherein the rear tubular member has a freely exposed outer peripheral surface capable of being manually gripped by a user of the writing instrument to effect angular displacement thereof to axially detract and extend the eraser.*

*34. A writing instrument according to claim 8; wherein the projection projects radially outwardly an extent farther than the farthest radial extent of the inner tubular member as viewed along the entire length of the inner tubular member excluding the rear end portion thereof.*

* * * * *